US010072805B2

(12) United States Patent
Bailey

(10) Patent No.: US 10,072,805 B2
(45) Date of Patent: Sep. 11, 2018

(54) RECESSED LIGHTING UNIT WITH UNIVERSAL ADAPTER

(71) Applicant: DMF, Inc., Carson, CA (US)

(72) Inventor: Michael D. Bailey, Long Beach, CA (US)

(73) Assignee: DMF, INC., Carson, CA (US)

( * ) Notice: Subject to any disclaimer, the term of this patent is extended or adjusted under 35 U.S.C. 154(b) by 301 days.

(21) Appl. No.: 14/726,064

(22) Filed: May 29, 2015

(65) Prior Publication Data

US 2016/0348860 A1 Dec. 1, 2016

(51) Int. Cl.

| | |
|---|---|
| ***F21S 8/02*** | (2006.01) |
| ***F21V 21/04*** | (2006.01) |
| ***F21V 21/08*** | (2006.01) |
| *F21V 15/01* | (2006.01) |
| *F21V 29/507* | (2015.01) |

(52) U.S. Cl.

CPC ..... *F21S 8/024* (2013.01); *F21S 8/026* (2013.01); *F21V 21/047* (2013.01); *F21V 21/08* (2013.01); *F21V 15/01* (2013.01); *F21V 29/507* (2015.01)

(58) Field of Classification Search

CPC ..... F21S 8/024; F21S 8/026; F21V 21/088; F21V 21/047; F21V 21/04; F21V 21/08; F21V 15/01

See application file for complete search history.

(56) References Cited

U.S. PATENT DOCUMENTS

| | | | | |
|---|---|---|---|---|
| 7,828,465 | B2 | 11/2010 | Roberge et al. | |
| 8,201,968 | B2 | 6/2012 | Maxik et al. | |
| 8,672,518 | B2 | 3/2014 | Boomgaarden et al. | |
| 9,417,506 | B1 * | 8/2016 | Tirosh | G03B 15/06 |
| 2005/0225966 | A1 * | 10/2005 | Hartmann, Jr. | F21S 8/02 362/147 |

FOREIGN PATENT DOCUMENTS

| | | |
|---|---|---|
| EP | 2306072 | 6/2011 |

* cited by examiner

*Primary Examiner* — Karabi Guharay
(74) *Attorney, Agent, or Firm* — Foley & Lardner LLP

(57) ABSTRACT

A recessed lighting unit for mounting to a ceiling or a wall is provided. The recessed lighting unit includes a thermally conductive housing, a light source module inside the housing, and an optical plate. The housing maybe engaged to a universal adapter through a simple twist and lock mechanism. The clips enable the universal adapter to be attached to junction boxes and recessed lighting can-type housings of different sizes. The universal adapter can receive different types of clips, without the use of screws, adhesives, or tools to attach the clips to the adapter. Such a recessed lighting unit may have a reduced set of components while ensuring its adaptability and easy installation. Other embodiments are also described and claimed.

18 Claims, 17 Drawing Sheets

RECESSED LIGHTING UNIT WITH UNIVERSAL ADAPTER

FIELD

An embodiment of the invention relates to a recessed lighting unit that is mounted behind a ceiling or a wall via its housing being engaged to an adapter. Other embodiments are also described.

BACKGROUND

Recessed lighting units are typically installed or mounted to a structural member of a dwelling behind a ceiling or a wall. Recessed lighting units generally consist of various components of different shapes and sizes. For example, different styles of trims and light source modules may be used to accommodate different needs of consumers.

Although current recessed lighting units come in a variety of shapes and sizes, switching between different components can be tedious and cumbersome. In particular, current systems require the removal of numerous screws and fasteners to change a single component of the system, such as a trim. Thus, there is a need for a lighting system that enables efficient interchangeability between different components.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known structures and techniques have not been shown in detail so as not to obscure the understanding of this description.

Figure 1:
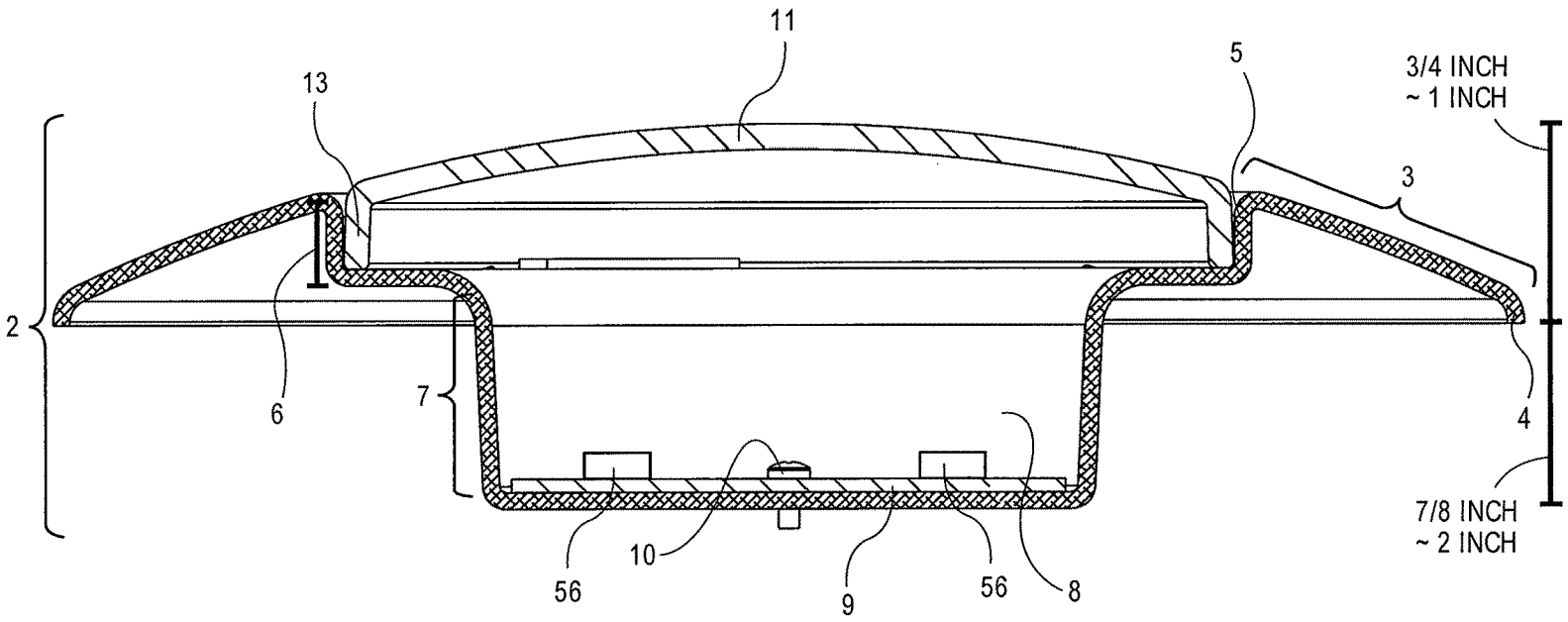
FIG. 1 shows a cross section view of a recessed lighting unit and its components, including a thermally conductive, die-formed housing according to one embodiment.

FIG. 1 shows a cross-section view of a recessed lighting unit 1 having a housing 2, an optical plate 11, and a light source module 9. The recessed lighting unit 1 is affixed on a ceiling or a wall 55 (e.g., see FIG. 15) to provide light into a room. The housing 2 serves to cover the exposed edge of the ceiling or wall 55 where a hole is formed and directly behind which the recessed lighting unit 1 resides. The housing 2 also serves to house a light source module 9 while allowing light from the light source module 9 to be emitted into a room through the opening in the ceiling or wall 55. In doing so, the housing 2 helps the recessed lighting unit 1 appear seamlessly integrated into the ceiling or wall 55.

Figure 2:
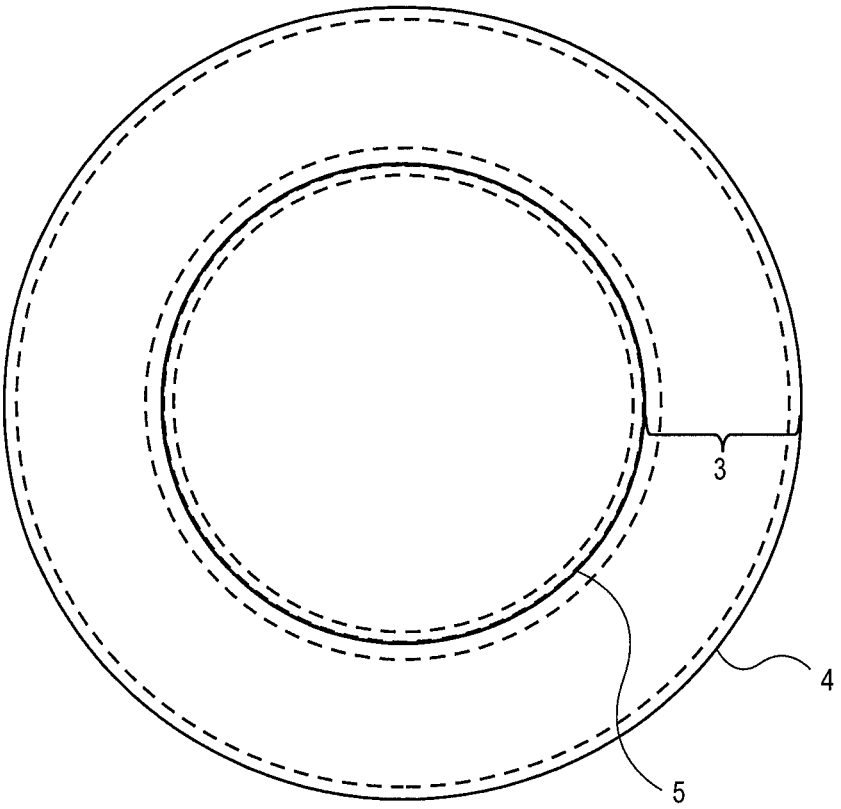
FIG. 2 shows an overhead view of the recessed lighting unit and its components, including the thermally conductive, die-formed housing according to one embodiment.
Figure 3:
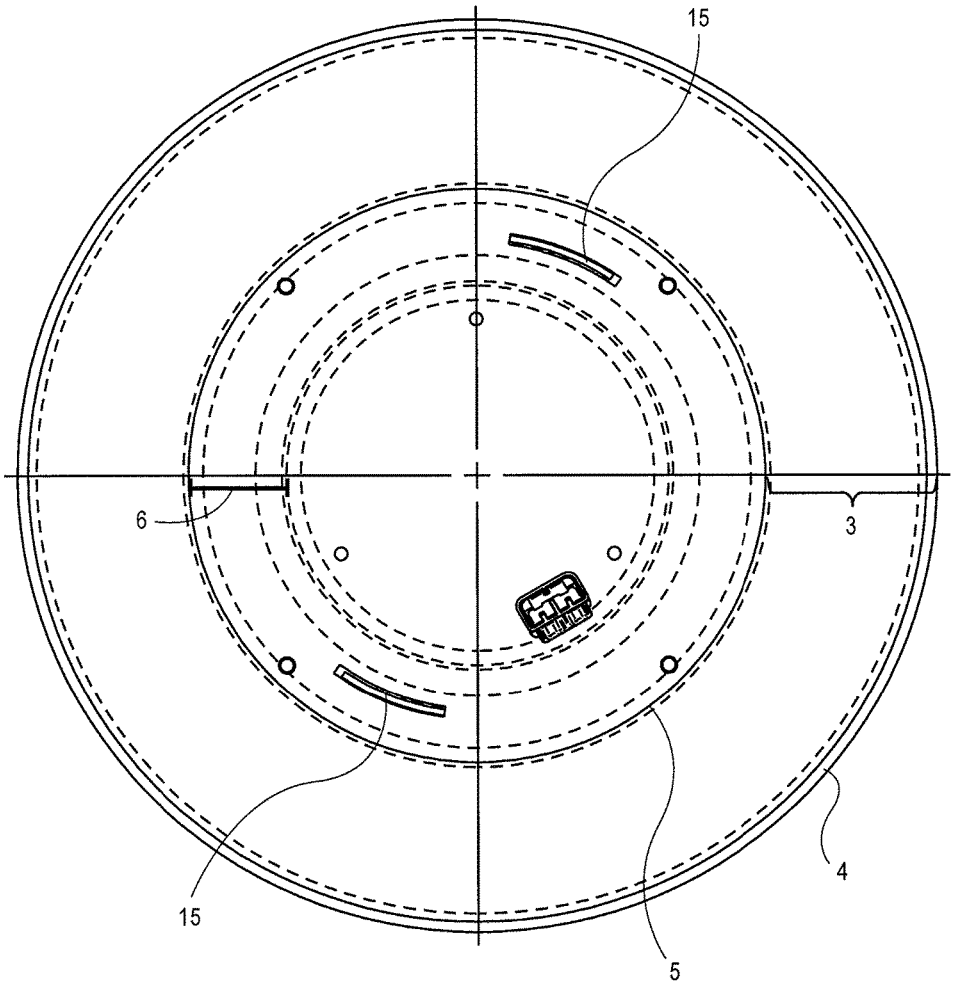
FIG. 3 shows an underneath view of the recessed lighting unit and its components, including the thermally conductive, die-formed housing according to one embodiment.

The housing 2 may have a trim portion 3 at its outer periphery as shown, and the trim portion 3 itself has an outer periphery 4 that is joined to an inner periphery 5 by a flat middle portion and forms a closed loop or closed band, e.g., ring shaped as shown in FIG. 2 (top view) and FIG. 3 (bottom view). The outer periphery 4 of the trim portion 3 may have a variety of shapes, e.g. circle (as shown in FIG. 2), square, octagon, etc. The inner periphery 5 may have the same shape as the outer periphery 4 (such as in the example here) or it may be different. The housing 2 has a wall that surrounds a central open space of the housing 2, and extends rearward and inward from the inner periphery 5 of the trim portion 3 as shown to form an intermediate portion 6. The intermediate portion 6 may have the same closed loop shape as the inner periphery 5 of the trim portion 3. The wall of the housing 2 then extends rearward and inward from the intermediate portion 6 to form a base 7. The base 7 may have a bottom that is flat as shown. A base cavity 8 may be defined as the space between the bottom of the base 7 and a plane parallel to the bottom that is at the base cavity height given in FIG. 1.

The housing 2 may be die-formed so that the trim portion 3 and base 7 are not separate pieces but are integrally formed from a single piece of metal. The housing 2 may act as a heat spreader (thermally conductive). The housing 2 may be made of aluminum, brass, copper, polymer steel, or any other material that is thermally conductive. A light source module 9 may be attached to the base 7 and positioned between the base 7 and a front-most point of the trim portion 3. The light source module 9 may be positioned inside the base cavity 8 and attached to the bottom of the base 7. The light source module 9 may be attached to the bottom of the base 7 by using one or more screws 10, glue, snapping mechanism, or the like. In one embodiment, screws 10 may be fitted into screw holes 59 on the bottom of the base 7.

Figure 4:
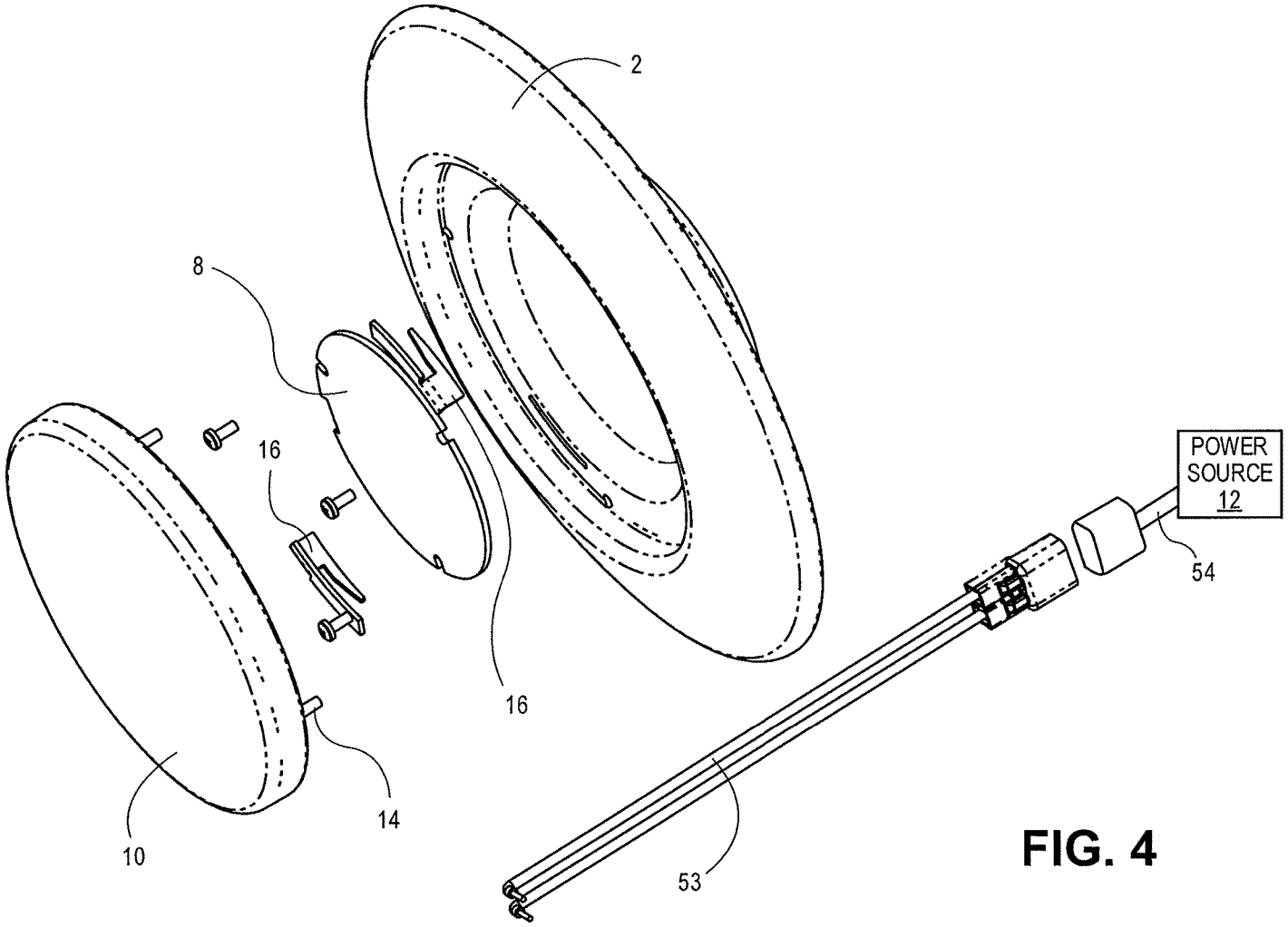
FIG. 4 shows an exploded view of the recessed lighting unit and its components, including the housing, locking members, light source module, and electrical wires, according to one embodiment.

The light source module 9 may include any electro-optical device or combination of devices for emitting light. One or more light emitting devices may be mounted to the thermally conductive housing 2. As shown in FIG. 1, for example, the light source module 9 may have as a single light source a light emitting diode (LED) 56, organic light-emitting diode (OLED) 56, or polymer light-emitting diode (PLED) 56 installed on a carrier structure (e.g., a printed circuit board or flex circuit). In some embodiments, the light source module 9 may have multiple light sources 56 (e.g., LEDs, OLEDs, and/or PLEDs). As shown in FIG. 4, the light source module 9 receives electricity from a power source 12 such that the light source module 9 may emit a controlled beam of light into a room or a surrounding area. In one embodiment, the light source module 9 may include a set of electrical leads positioned in its carrier structure, for receiving electricity from the power source 12 via electrical contacts. The electrical leads of the light source module 9 may be soldering points that are traditionally coupling areas for one or more electrical wires 53 that are directly soldered to the light source module 9 and connect the light source module 9 with the power source 12. The power source 12 (which may include an electronic power supply circuit) is designed to ensure that the appropriate voltage and current are fed to the light source module 9 to enable the emission of light by the one or more light sources within the light source module 9. In one embodiment, an AC to DC power conversion module with a 120 Volt AC input may be used whose input is connected to the AC wiring. In one embodiment, the AC to DC power conversion module can be integrated as part of the light source module 9.

An optical plate 11 (e.g., FIG. 4) may be provided to converge, diverge, or otherwise modify (e.g., filter) light emitted by the light source module 9. The optical plate 11 may include a lens with a single optical element or a compound lens having of an array of simple lenses (elements) with a common axis. In one embodiment, the optical plate 11 also provides a protective barrier for the light source module 9 and shields the light source module 9 from moisture or inclement weather. The optical plate 11 may also assist in the diffusion of light and increase the uniformity of light over the surface of the recessed lighting unit 1. The optical plate 11 may be made of any at least partially transparent material, including glass and hard plastics. The optical plate 11 may have some opacity so that some light may be diffused and the inside of the housing 2 is hidden from view. When the recessed lighting unit 1 is turned on, the light source module 9 illuminates a back face of the optical plate 11.

The optical plate 11 may be attached to the intermediate portion 6. An outer periphery 13 of the optical plate 11 conforms to an outer periphery of the intermediate portion 6 so that a space between the optical plate 11 and the base 7 is enclosed. The optical plate 11 may be attached to the intermediate portion 6 by a snapping mechanism, glue, heat stake, or the like. Heat staking may involve using multiple pins 14 (e.g., FIG. 4) located on the optical plate 11, such as plastic rivets, that extend rearward and through multiple pin holes 58 on the intermediate portion 6 of the wall of the housing 2, see FIGS. 1 and 3, at which point they may be melted so as to attach the optical plate 11 to the intermediate portion 6.

As shown in FIG. 1, in one embodiment, the height from the outside bottom of the base 7 up to the lowest point of the outer periphery 4 of the trim portion 3 is between ⅞ inch to 2 inches, and the height from the outer periphery 4 to the top of the optical plate 11 is ¾ inch to 1 inch. The largest width distance between opposite points on the outer periphery 4 of the trim portion 3 may be 4 inches to 6 inches, or 6 inches to 8 inches. However, it is understood that different styles and sizes may be used.

Figure 6:
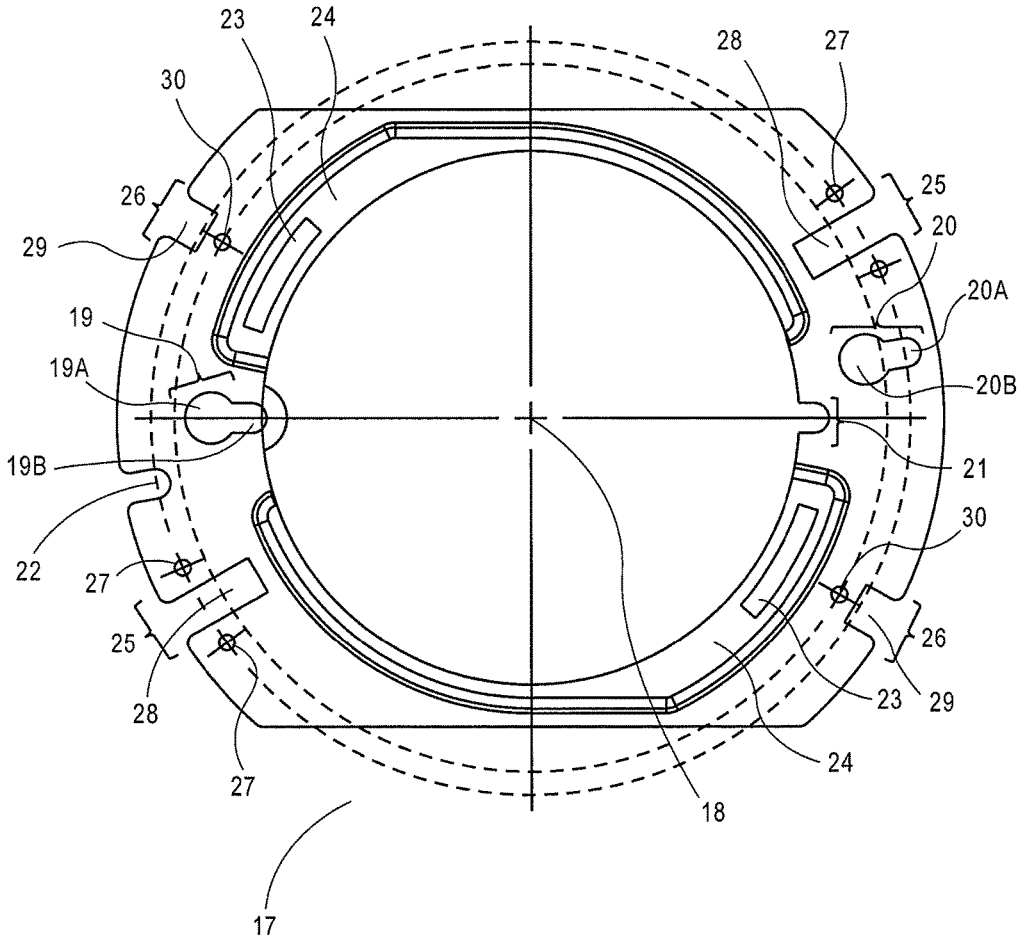
FIG. 6 shows a view of a universal adapter according to one embodiment.
Figure 15:
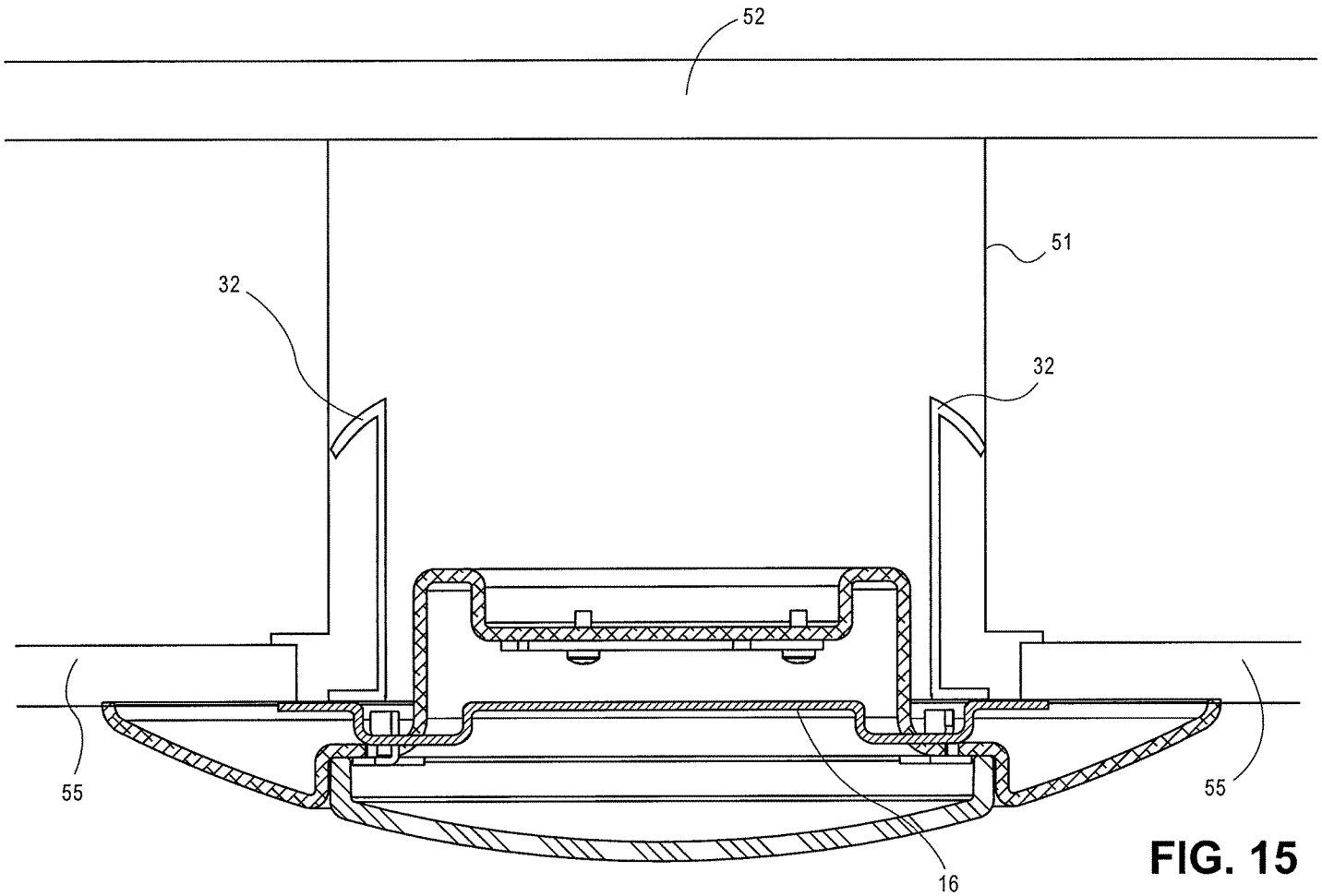
FIG. 15 shows a cross section view of a recessed lighting unit, universal adapter, friction clips, incandescent style housing, and beam, according to one embodiment.

The recessed lighting unit 1 is installed through an opening on the wall or ceiling 55—see FIG. 15. As shown in FIG. 4, the power source 12, located behind the wall or ceiling 55, has one or more electrical wires 54 that deliver power (and optionally control or other information) to the light source module 9. In one embodiment, the light source module 9 has one or more electrical wires 53 connected to it, at the end of which is an electrical connector that mates with the one that is at the end of the one or more electrical wires 54 that are connected to the power source 12. Other ways of electrically connecting the light source module 9 to the power source 12 are possible, including a hardwired approach in which there is no intervening pair of mating connectors (which are shown in FIG. 4). The recessed lighting unit 1 is then affixed in position, using several alternatives. It may be engaged to a universal adapter 17 that is either attached to a junction box 30, 31 (e.g., FIG. 17), or to an incandescent style housing 51 (e.g., FIGS. 15-16) both of which can be affixed to a beam 52 behind the wall or ceiling 55. Referring to FIG. 6, the recessed lighting unit 1 may be engaged to the universal adapter 17 by inserting its base 7 into an opening 18 of the universal adapter 17, and then by twisting the housing 2 relative to the universal adapter 17, through a twist and lock mechanism.

In one embodiment, the twist and lock mechanism may have two or more locking members 16 each of which is to pass through a respective one of two or more arcuate openings 15 or 23 and then friction fit into a fixed position in response to the relative twist motion. The two or more locking members 16 may be formed (e.g., directly formed through a molding process or attached as separate pieces) on the housing 2 on the intermediate portion 6, for example. If the locking members 16 are formed on the intermediate portion 6 of the housing 2, then the corresponding arcuate openings 23 are formed on the universal adapter 17. Conversely, if the locking members 16 are formed on the universal adapter 17, then corresponding arcuate openings 15 are formed on the intermediate portion 6 of the housing 2 (see FIG. 3). Arcuate openings 23 may still be formed on the universal adapter 17 even though the locking members 16 are formed on the universal adapter 17. Arcuate openings 15 may still be formed on the housing 2 at the intermediate portion 6 even though the locking members 16 are formed on the housing 2. In this manner, the same housing 2 may be used for both versions of the twist and lock mechanism. The twist and lock may be accomplished by inserting the locking members 16 into arcuate openings 23 or 15, depending on whether the locking members 16 are formed on the housing 2 or on the universal adapter 17, and then twisting the housing 2 relative to the universal adapter 17 until a tight friction fit is reached between the locking members 16 and the adjoining surface (of the universal adapter 17 or of the wall of the housing 2) in which the openings 23 or 15 are formed. The locking members 16 may be arranged so that the housing 2 may be twisted in a clockwise or counterclockwise direction.

Figure 5:
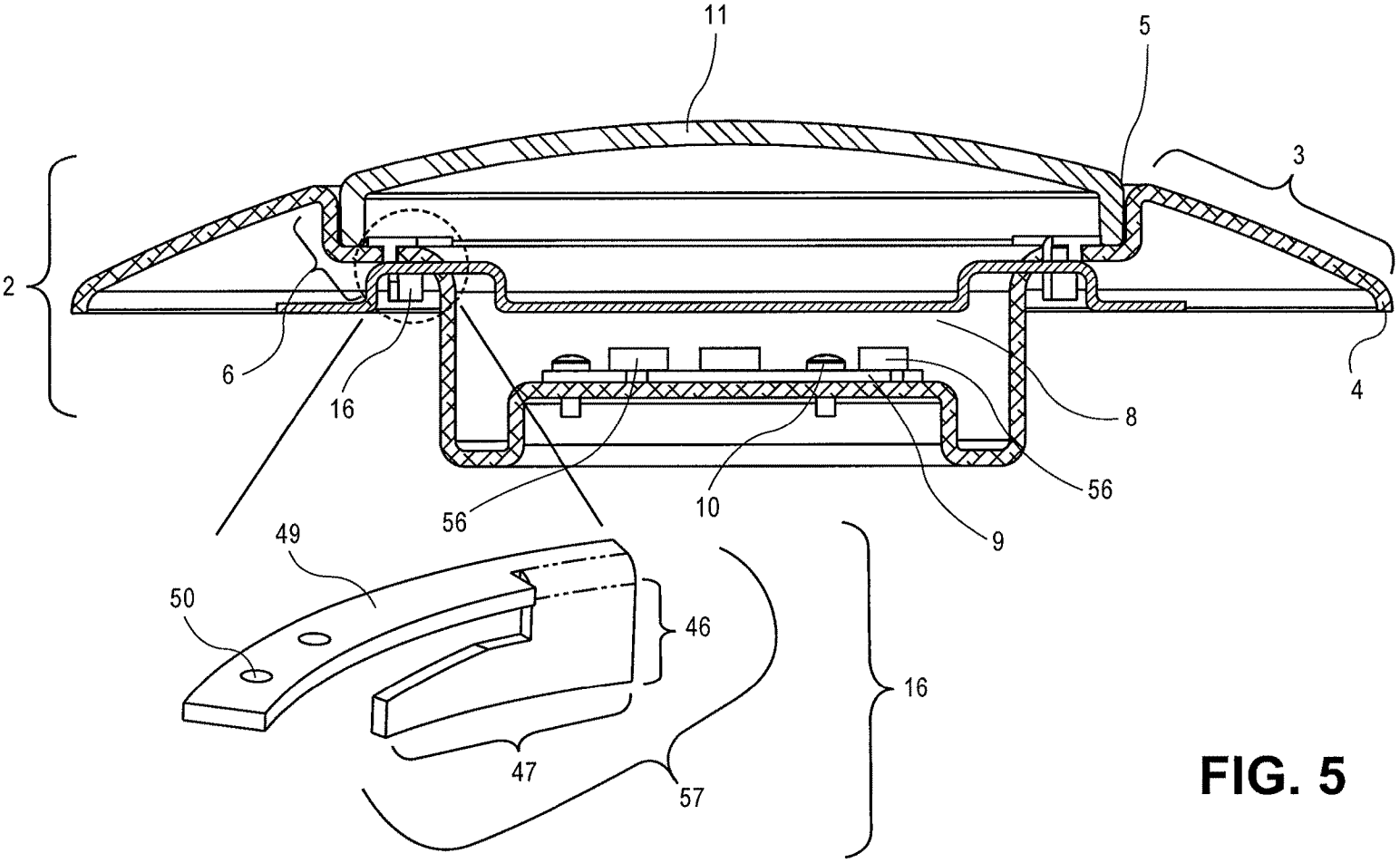
FIG. 5 shows a cross section view of the housing engaged to a universal adapter through a twist and lock mechanism, according to one embodiment.

FIG. 5 shows an embodiment of the locking member 16. The locking member 16 may have an attaching portion 49 and a locking portion 57. The locking member 16 may be formed by cutting or stamping out a flat, single piece of metal having the portions 49, 46, 47 and then bending the portion 46 backward relative to the portion 49 (by about ninety degrees in this case), resulting in the L-shaped piece shown in FIG. 5. The attaching portion 49 may have one or more openings 50 for a screw, nail or a pin that may be used to attach the attaching portion 49 of the locking member 16 onto the intermediate portion 6 of the housing 2, or onto the universal adapter 17. In another embodiment, attaching portion 49 of the locking member 16 may be attached by a snapping mechanism or an adhesive, such as glue. FIG. 5 shows an embodiment of the attaching portion 49 that is attached to the intermediate portion 6 of the housing 2, as the locking portion 57 is inserted into an arcuate opening 15 (not directly shown in FIG. 5, but see FIG. 3). The locking portion 57 may have a vertical portion 46 and a lateral portion 47. The vertical portion 46 and the lateral portion 47 may generally be shaped like an "L" as shown, or a hook. The locking member 16 may have an arcuate shape that corresponds to the arcuate shape of the arcuate openings 15, 23 for insertion for enabling a twisting or rotational movement between the universal adapter 17 and the housing 2. As shown in FIG. 4, the locking members 16 are arranged so that the housing 2 may be twisted in a counterclockwise direction in order to lock the housing 2 to the universal adapter 17. This shows two locking members 16 on opposite sides (farthest from each other) of a center of the housing 2, where one locking member 16 points in the opposite direction with respect to the other locking member 16. In another embodiment where the locking members 16 are formed on the universal adapter 17, the locking members 16 may also be similarly arranged.

FIG. 3 shows a bottom view of one embodiment of the housing 2 with two arcuate openings 15. Two arcuate openings 15 (where each opening 15 may be described as a slot, slit, or hole) may be formed on the intermediate portion 6 of the housing 2. In one embodiment, a set of two arcuate openings 15 as shown are formed on the intermediate portion 6 and located so that they are diametrically opposed to each other. Each of arcuate openings 15 is shaped to receive a respective locking member 16 as shown in FIGS. 4 and 5. The plurality of locking members 16, for engaging a universal adapter 17, are attached to the intermediate portion 6 so that a portion of each of the plurality of locking members 16 extend rearward through a plurality of arcuate openings 15 on the intermediate portion 6 of the housing 2. As seen in FIG. 5, each of the locking portions 57 of the locking members 16 may be inserted through its respective arcuate opening 15 formed on the intermediate portion 6. Attaching portion 49 of each locking member 16 may be attached to the intermediate portion 6 of the housing 2. The locking portions 57 of the locking members 16 extend rearward from the intermediate portion 6 of the housing 2.

In another embodiment (not shown), there may be three or more arcuate openings 15 on the intermediate portion 6 of the housing 2 with three or more locking members 16 formed thereon. The three arcuate openings 15 may be located equidistant from each other, and at the same radial distance from the center of the housing 2, each having a respective one of three or more locking members 16 attached thereto. The universal adapter 17 may have corresponding three or more arcuate openings 23.

In another embodiment (not shown), the locking members 16 may be directly formed on the intermediate portion 6 of the housing 2, rather than being attached as separate pieces. For example, locking members 16 may be formed via a molding process, or by cutting out slits or notches into the intermediate portion 6 of the wall of the housing 2 as needed to form the portions 46, 47, and then bending the portion 46 backward, i.e., in a downward direction as depicted in the sectional view of FIG. 5, to result in the configuration of the locking member 16 shown in FIG. 5. Similar to locking members 16 that are attached as separate pieces (described above), the directly formed locking members 16 would extend rearward from the intermediate portion 6. The base 7 of housing 2 would be inserted into opening 18 of the universal adapter 17, locking members 16 would be inserted into corresponding arcuate openings 23 of the universal adapter 17, and housing 2 would be twisted and locked onto the universal adapter 17. A portion (e.g., locking portion 57) of each of the plurality of locking members 16 on the intermediate portion 6 of the housing 2 extend rearward through each of the plurality of arcuate openings 23 on the universal adapter 17 so that the housing 2 and the universal adapter 17 are in a locked position. In this embodiment, it is not necessary to create the separate arcuate openings 15 on the intermediate portion 6, nor any need for inserting the locking members 16 through such arcuate openings 15, since the locking members 16 are being formed integrally with the wall of the housing 2.

Figure 10:
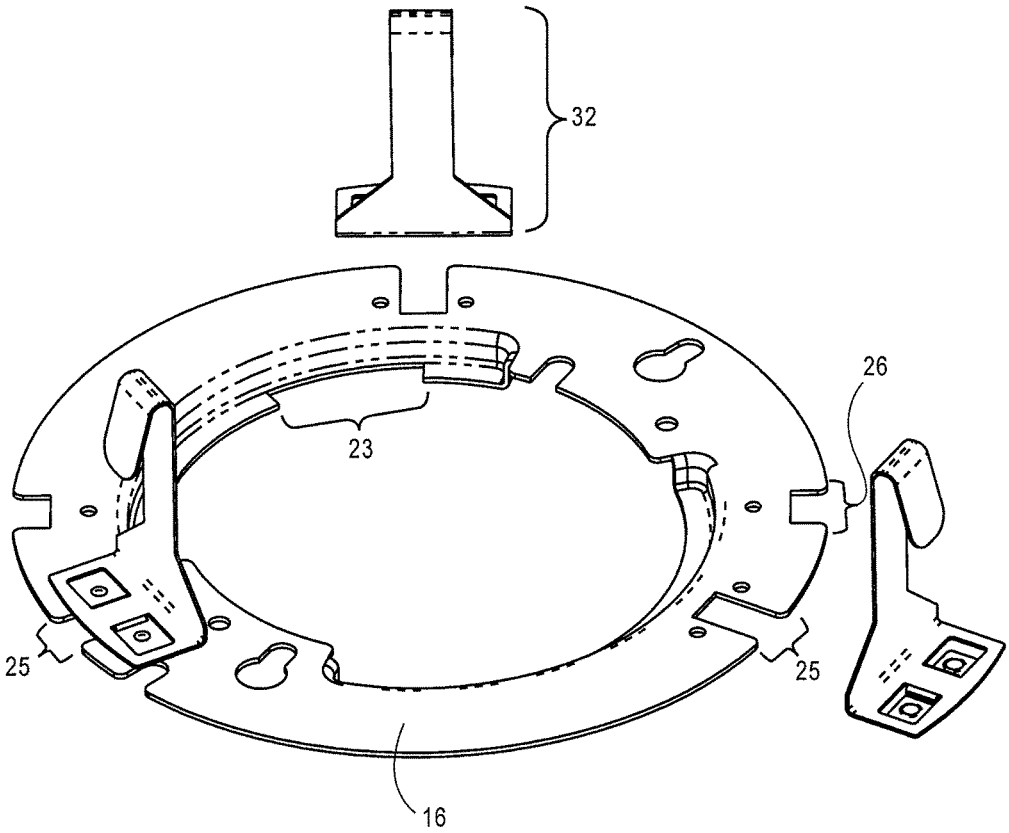
FIG. 10 shows a perspective view of friction clips attached to the universal adapter according to one embodiment.
Figure 11:
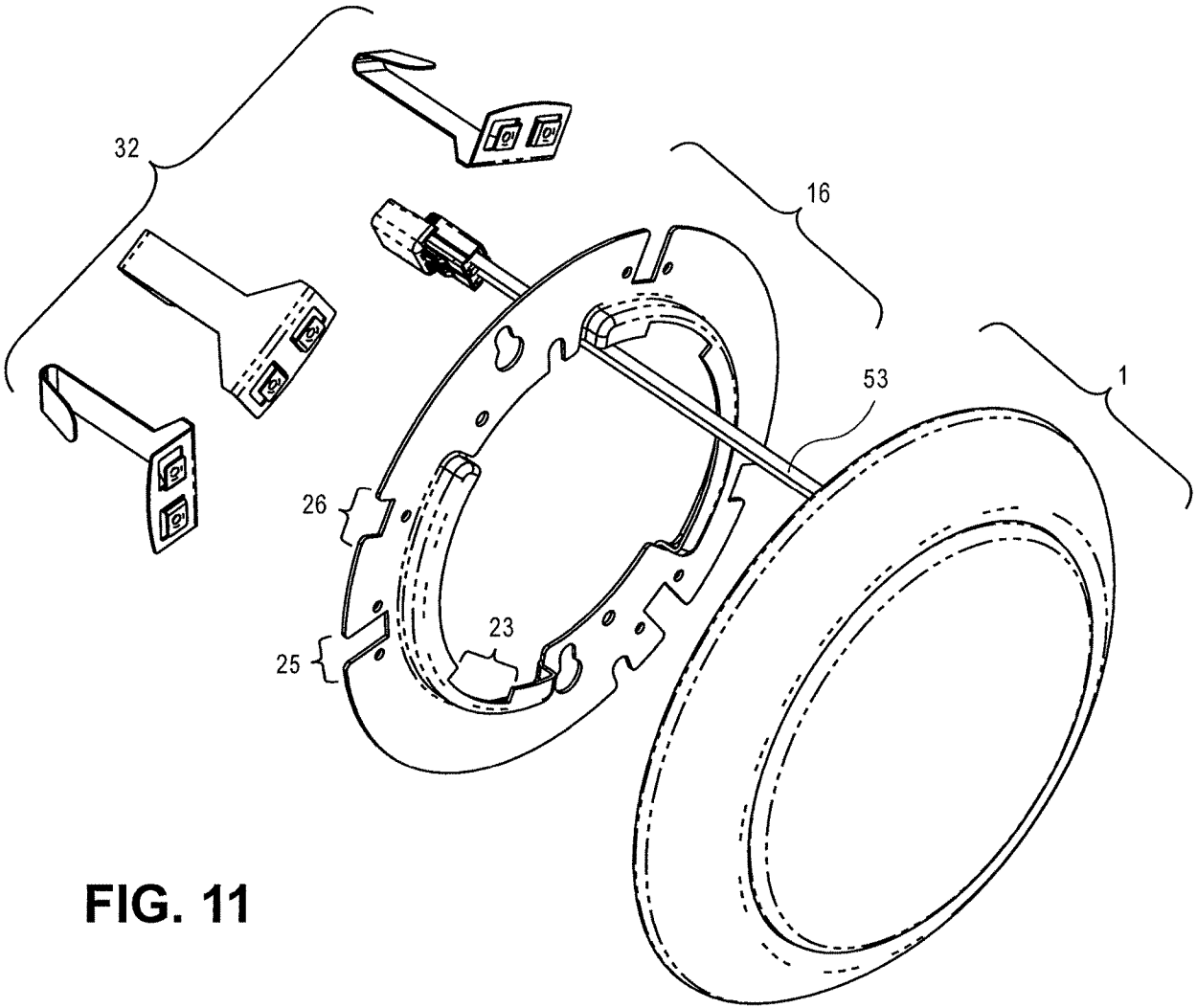
FIG. 11 shows an exploded view of a recessed lighting unit and its components including the universal adapter and friction clips, according to one embodiment.

FIG. 6 shows an embodiment of a universal adapter 17. The universal adapter 17 may be a band that forms a closed loop, which can have a variety of shapes (e.g., circular, square, octagonal, etc.). The universal adapter 17 may have an inner circumference or inner edge that surrounds a central opening 18. The universal adapter 17 may have two arcuate openings 23 that are positioned to receive the corresponding locking members 16 which are formed on intermediate portion 6. A portion (e.g., locking portion 57) of each of the plurality of locking members 16 on the intermediate portion 6 of the housing 2 extend rearward through each of the plurality of arcuate openings 23 on the universal adapter 17 so that the housing 2 and the universal adapter 17 are in a locked position. Each arcuate opening 23 may be completely enclosed by the band (e.g., slot, slit, or hole as shown in FIG. 6) or it may be only partially enclosed (e.g., a notch, as shown in FIGS. 10 and 11). Each arcuate opening 23 is capable of receiving a corresponding locking member 16 formed on the intermediate portion 6 of the housing 2. Arcuate opening 23 is shaped, sized, and positioned on the universal adapter 17 so that it clears a locking member 16 (or allows the locking member 16 to pass through it) when the universal adapter 17 is being locked onto the housing 2. Still referring to FIG. 6, in one embodiment, the universal adapter 17 may have one or more of ramped protrusions 24 that have arcuate openings 23 formed thereon. In one embodiment, arcuate openings 23 may be positioned at or near the inner edge or circumference of the universal adapter 17.

Figure 7:
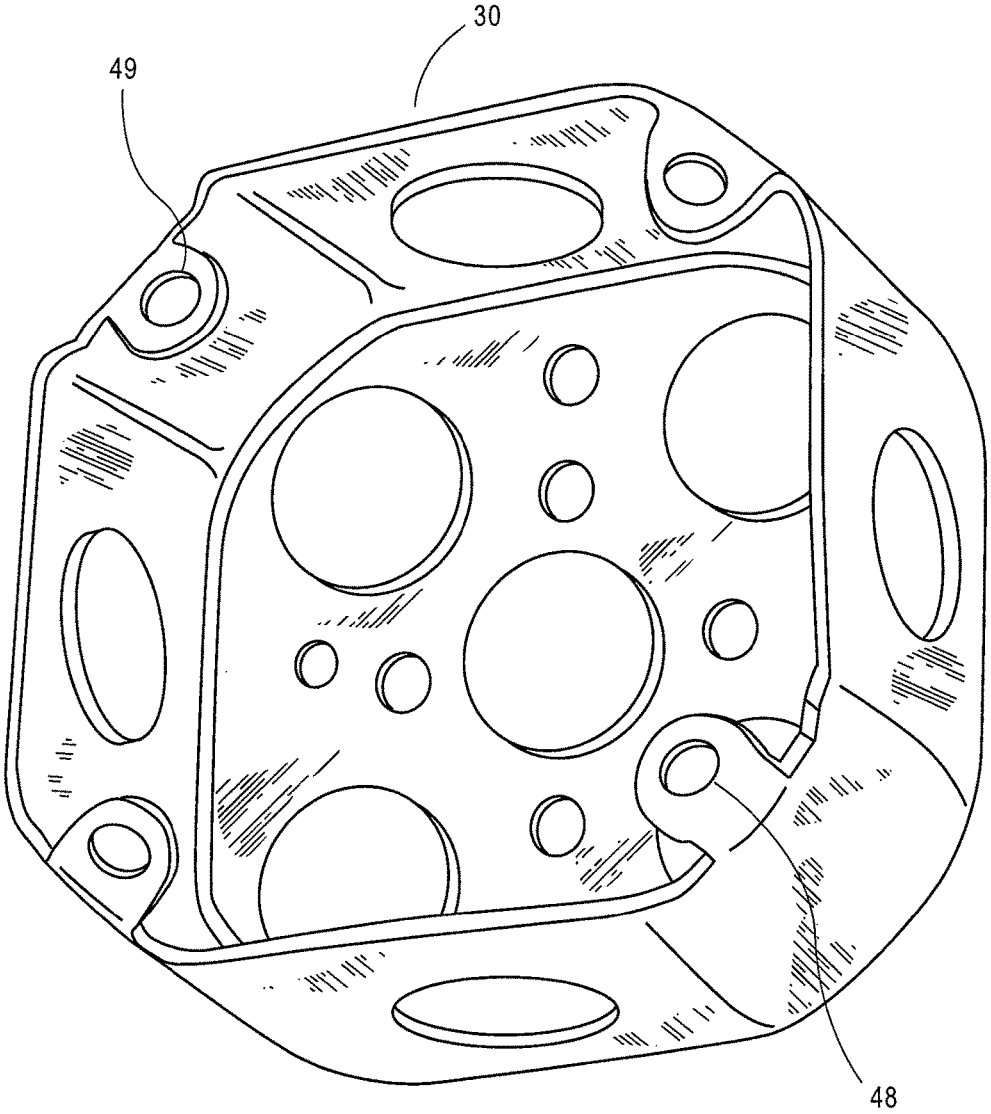
FIG. 7 shows a view of an octagonal junction box.
Figure 8:
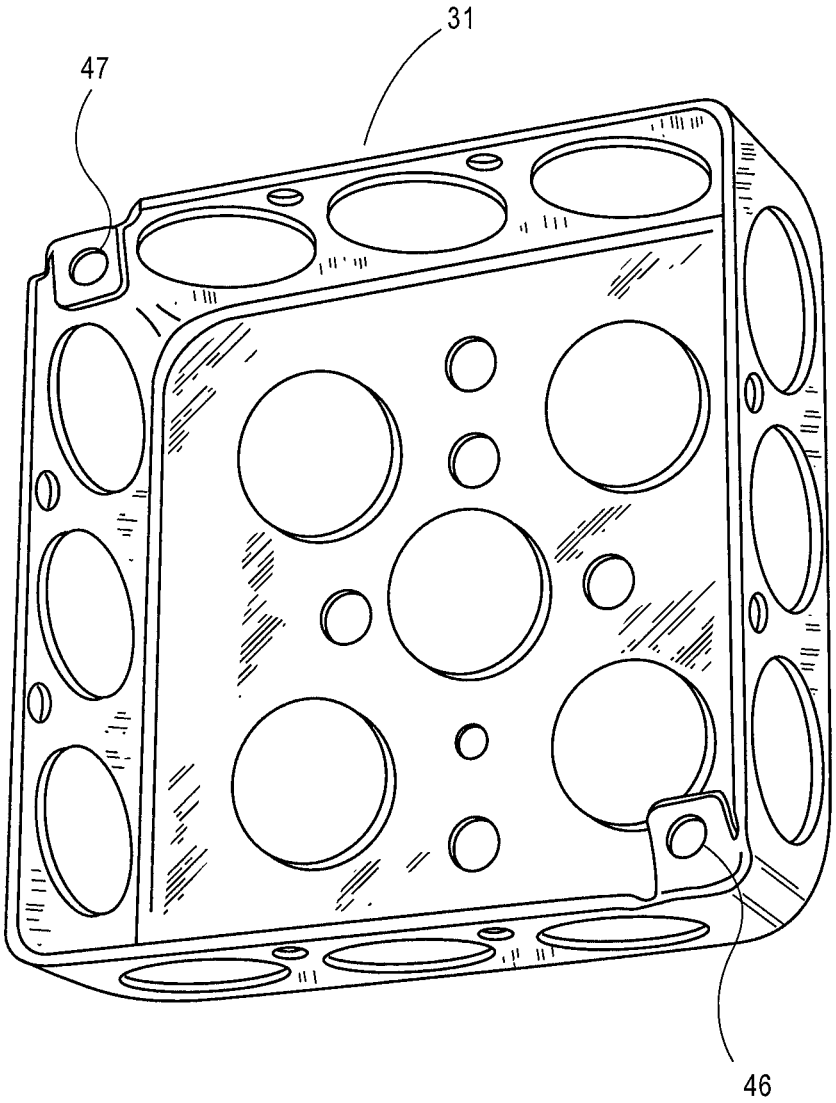
FIG. 8 shows a view of a four-sided junction box.

As shown in FIG. 6, the universal adapter 17 may have attaching member openings 19-22 capable of receiving attaching members (which may include screws, pins, nails, nuts and bolts, and the like), as a way for the universal adapter 17 to be attached to a junction box 30, or 31—see FIGS. 7 and 8. An attaching member opening 19-22 need not be a perfect circle and may instead be formed in a variety of shapes. For example, the attaching member opening 21 need not be a fully enclosed circle, but rather may be a partial circle or an open rounded notch as shown in FIG. 6. In another example, as shown in FIG. 6, the attaching member opening 19 may be a slotted hole, shaped so that it forms a partial circle on one side 19*a* and an oblong circle or oval on the other side 19*b*. An attaching member, such as a screw for example, may be inserted in side 19*a* and then the universal adapter 17 may be shifted sideways so that the screw rests against the edge of the side and its head cannot pass through side 19*b*, of the attaching member opening 19. This allows the attaching member opening 19 to be keyed into position. The attaching member opening 19 may be positioned on the universal adapter 17 so that one side of the attaching member opening (e.g., 19*a*) has a different radial distance from the center of the universal adapter 17 than the other side of the attaching member opening (e.g., 19*b*), thereby allowing the universal adapter 17 to be fitted to screws. Attaching member opening 21, for example, may be positioned at the inner circumference or inner edge of the universal adapter 17 and shaped as a notch. Attaching member opening 22, in another example, may be positioned at an outer circumference or outer edge of universal adapter 17, also shaped as a notch. An attaching member, such as a screw, may be inserted in the attaching member opening 19 at two different positions, an inside position (side 19*b*) and an outside position (side 19*a*), depending on the size of the junction box. A second attaching member opening 20 of the universal adapter 17 may be formed in a similar manner, having sides 20*a*, 20*b* as shown.

Attaching member openings 19-22 allow the universal adapter 17 to be attached to junction boxes of different sizes. The attaching member openings 19-22 may be arranged on the universal adapter so that the distance between the pair of attaching member openings 19 and 21 corresponds to the distance between two holes 48 (diagonally) on one type of junction box, and the distance between the pair of attaching member openings 20 and 22 corresponds to the distance between two holes 48 (diagonally) on another type of junction box. Attaching members may be inserted into holes 48. For example, the universal adapter 17 may be attached to an octagonal junction box 30 (shown in FIG. 7) or a four-sided junction box 31 (shown in FIG. 8). In one embodiment, a pair of attaching members, such as screws, may be inserted into the attaching member opening 20 and the attaching member opening 22 on the universal adapter 17 to fit two holes 48 on a four-sided junction box 31. In another embodiment, a pair of attaching members, such as screws, may be inserted into the attaching member opening 19 and the attaching member opening 21 on the universal adapter 17 to fit two holes 48 on an octagonal junction box 30.

Thus, there may be a four attaching member opening configuration where the universal adapter 17 has a first set of two attaching member openings 19, 21 each capable of receiving an attaching member, each located on opposite sides or halves of the universal adapter 17 that allow the universal adapter 17 to be attached to a first junction box. The universal adapter 17 has a second set of two attaching member openings 20, 22 each capable of receiving an attaching member, each located on opposite sides or halves of the universal adapter 17, that allows the universal adapter 17 to be attached to a second junction box. The distance between the first set of two attaching member openings 19, 21 is different than the distance between the second set of two attaching member openings 20, 22. As stated above, each opening may have an inside position and an outside position. This configuration would allow the universal adapter 17 to fit two or more different types of junction boxes.

In another embodiment (not shown), there may be a three-opening configuration the universal adapter 17 has a first opening capable of receiving an attaching member that allows the universal adapter 17 to be attached to a first junction box or a second junction box. The universal adapter 17 has second opening capable of receiving an attaching member that allows the universal adapter 17 to be attached to the first junction box. The universal adapter 17 has a third opening capable of receiving an attaching member that allows the universal adapter to be attached to the second junction box. Both the second opening and the third opening are located on opposite sides or halves of the universal adapter 17 relative to the first opening. The distance between the first opening and the second opening is different than the distance between the first opening and the third opening. Thus, the universal adapter 17 may be attached to a first junction box through the first opening and the second opening. The universal adapter 17 may be attached to a second junction box through the first opening and the third opening. As stated above, each opening may have an inside position and an outside position. This configuration also would allow the universal adapter 17 to fit two or more different types of junction boxes.

As shown in FIG. 6, the universal adapter 17 may have two or more clip holders 25 and 26 capable of being attached to two or more clips 32, 39. Clip holders 25 and 26 may be formed on the outer circumference or outer edge of the universal adapter 17. In one embodiment, two clips may be attached to two clip holders, but more clips and clip holders may be used. Clip holders 25 and 26 may be formed so that different types of clips may be attached to the universal adapter 17 without the use of screws, adhesives, or tools.

Friction clips 32 are used to attach the universal adapter 17 to an incandescent style housing 51 behind the wall or ceiling 55. Incandescent style housing 51 may be attached to a beam 52 behind the wall or ceiling 55. As shown in FIG. 10, two or more friction clips 32, for example, are first attached to clip holders 25 of universal adapter 17. The friction clips 32 are inserted into the opening of the incandescent style housing 51 so that the friction clips 32 rub up against an internal surface of the incandescent style housing 51. Friction between the internal surface of the incandescent style housing 51 and the friction clips 32 hold the universal adapter 17 in place. As shown in FIG. 15, the housing 2 can be engaged to the universal adapter 17 through the twist and lock mechanism in this embodiment.

Figure 13:
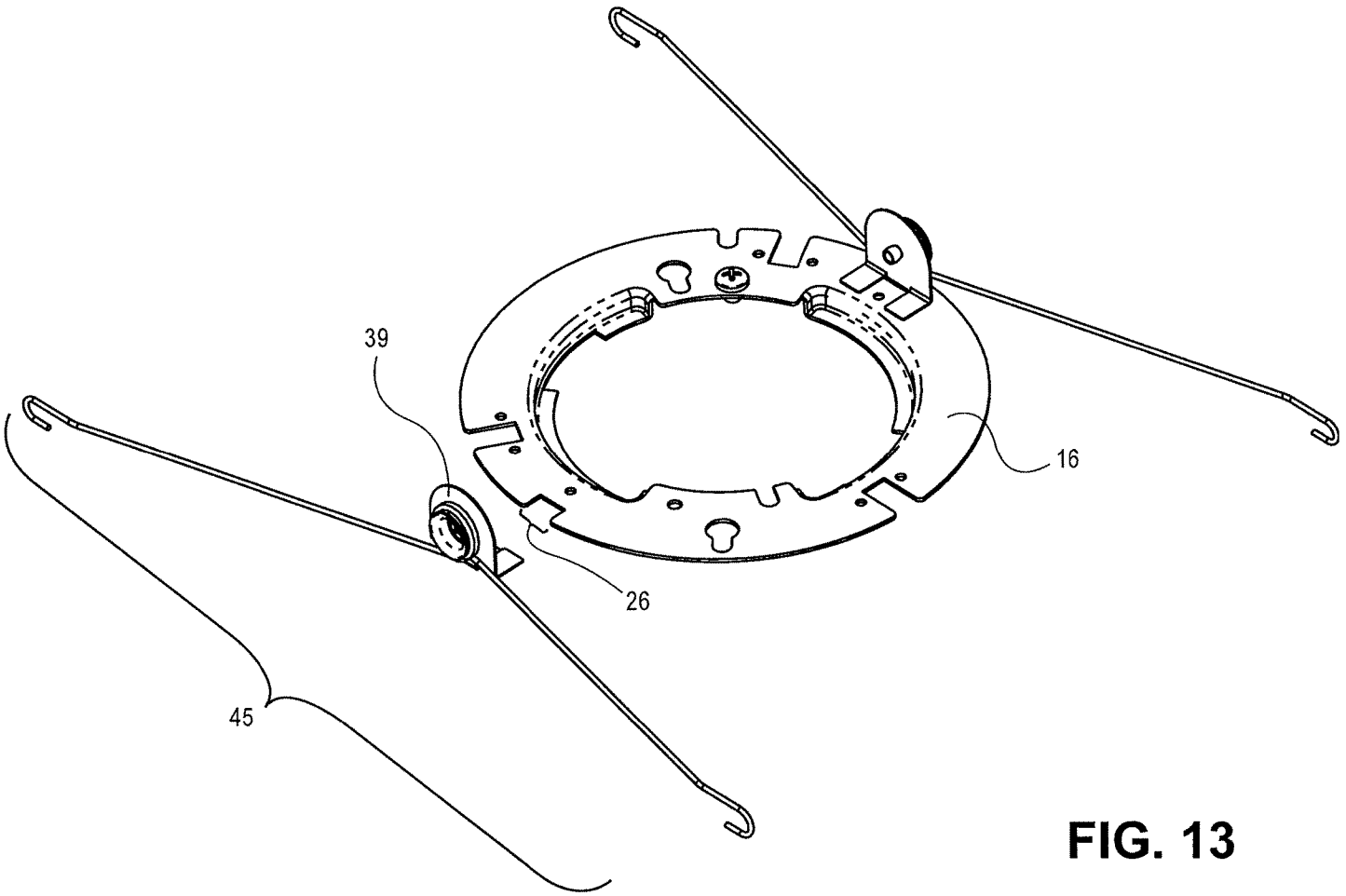
FIG. 13 shows a perspective view of torsion spring assemblies being attached to the universal adapter, according to one embodiment.
Figure 16:
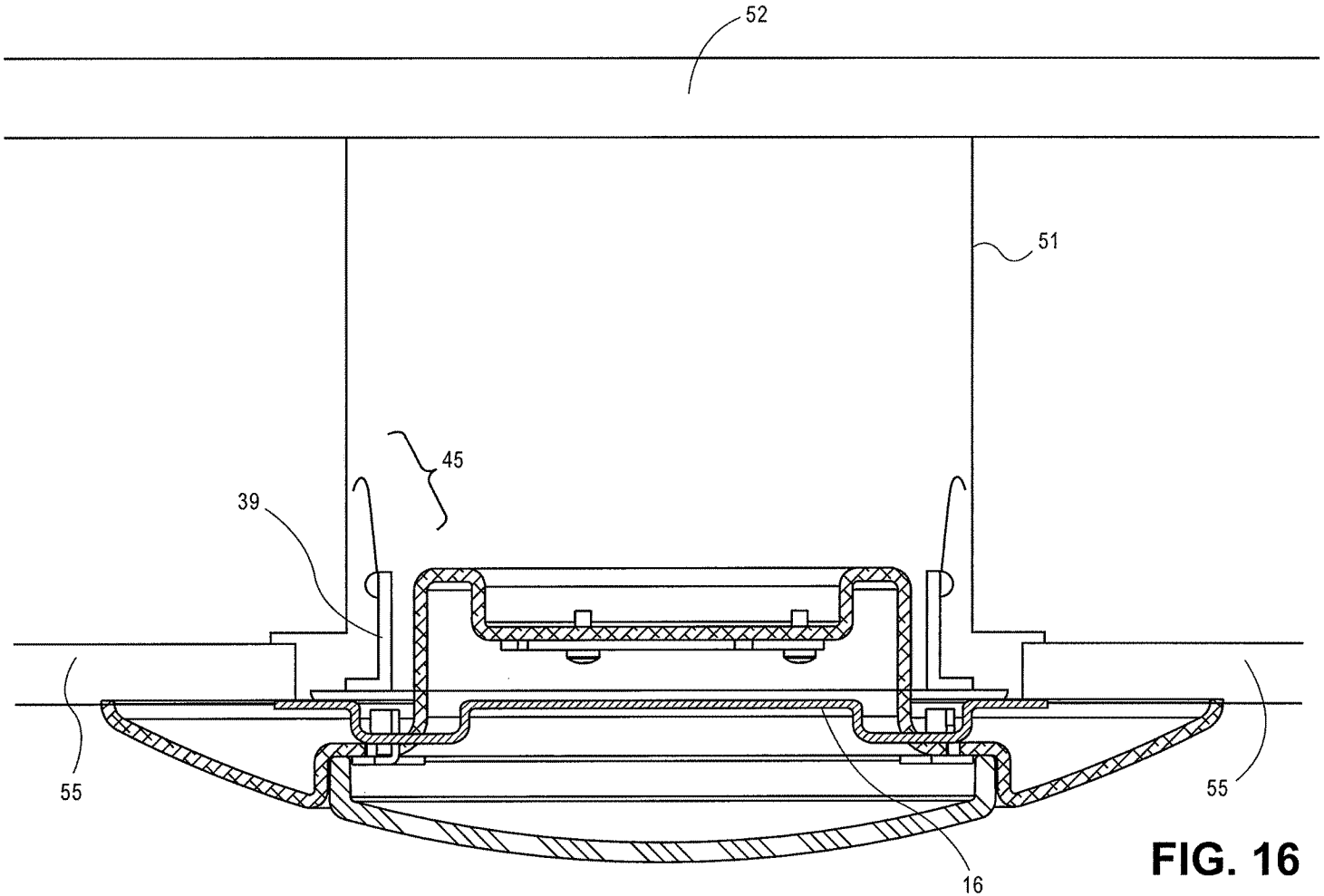
FIG. 16 shows a cross section view of a recessed lighting unit, universal adapter, torsion spring assemblies, incandescent style housing, and beam, according to one embodiment.
Figure 17:
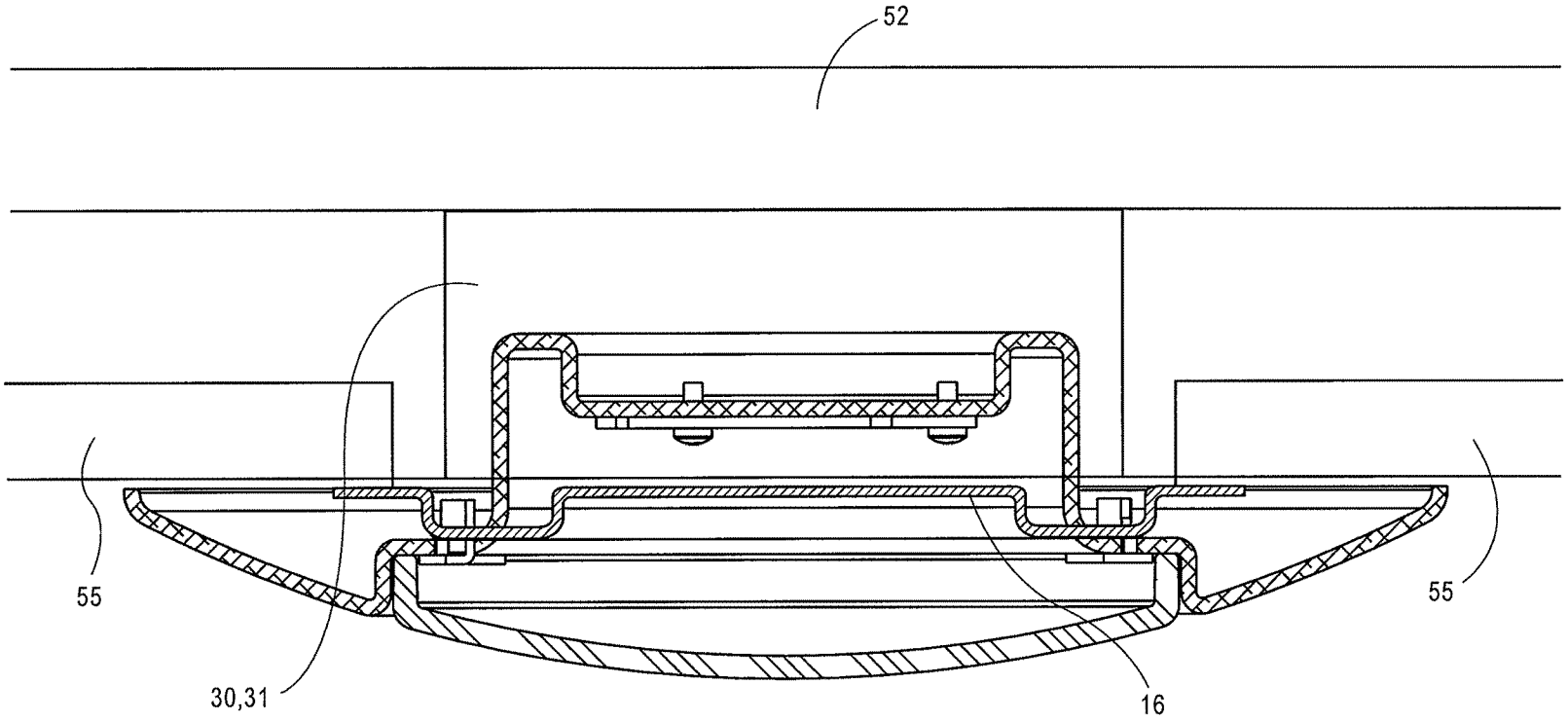
FIG. 17 shows a cross section view of a recessed lighting unit, universal adapter, junction box, and beam, according to one embodiment.

In another embodiment, torsion spring assemblies 45 may be used to attach the universal adapter 17 to an incandescent style housing 51 behind the wall or ceiling 55. As shown in FIG. 13, torsion spring assembly 45 has a torsion clip 39. Two torsion spring clips 39, for example, are first attached to clip holders 26 of the universal adapter 17. The torsion spring assemblies 45, while attached to universal adapter 17, are inserted into an opening of the incandescent style housing 51 so that the torsion spring assemblies 45 are hooked onto supporters attached to the internal surface of the incandescent style housing 51. The torsion spring assemblies 45 are attached to the supporters inside the incandescent style housing 51, and the universal adapter 17 is held in place. As shown in FIG. 16, the housing 2 can be engaged to the universal adapter 17 through the twist and lock mechanism in this embodiment.

Figure 9:
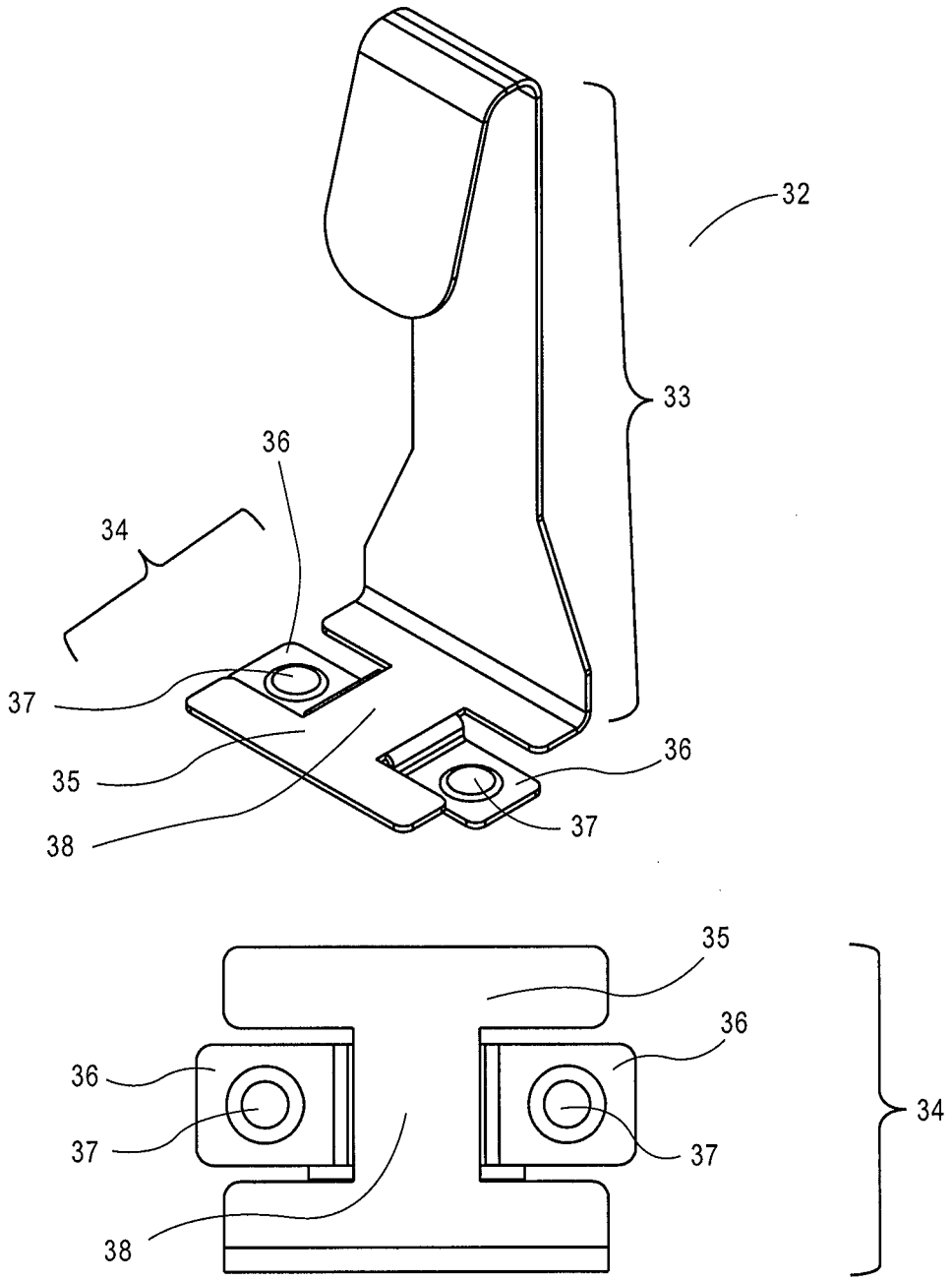
FIG. 9 shows a perspective view, and bottom view of a friction clip according to one embodiment.

In one embodiment, a clip holder 25 may be formed as a notch 28 with a pair of adjacent bump openings 27 as shown in FIG. 6. Notches 28 may have a variety of shapes (e.g., circular, rectangular, square, or V-shape), and may be formed by cutting out a portion of the outer circumference or edge of the universal adapter 17. Each bump opening 27 is positioned adjacent to the notch 28. The corresponding clip, a friction clip 32 for example, may have a vertical clip portion 33, and a base clip portion 34 that the shape of an "H" as shown in FIG. 9. The friction clip 32 may attach the housing 2 into an incandescent style housing 51 behind the ceiling or wall 55. Two or more friction clips 32 may be used. The base clip portion 34 may be formed at the bottom of the vertical clip portion 33. The base clip portion 34 may have two parallel bars 35 connected by a center bar 38. The two parallel bars 35 and the center bar 38 may be on the same plane. In another embodiment, as shown in FIGS. 10 and 11, it is also possible to have the two parallel bars 35 that may be connected at their ends by two additional bars parallel to the center bar 38. The vertical clip portion 33 may be connected to the base clip portion 34 along the length of one of the two parallel bars 35. A pair of flanges 36 may extend outwardly on a lower plane from the center bar 38. Each flange 36 may have a bump 37. As shown in FIG. 10, the base clip portion 34 is inserted into the clip holder 25 so that the bumps 37 engage the bump openings 27 to secure the clip 32 to the universal adapter 17.

Figure 12:
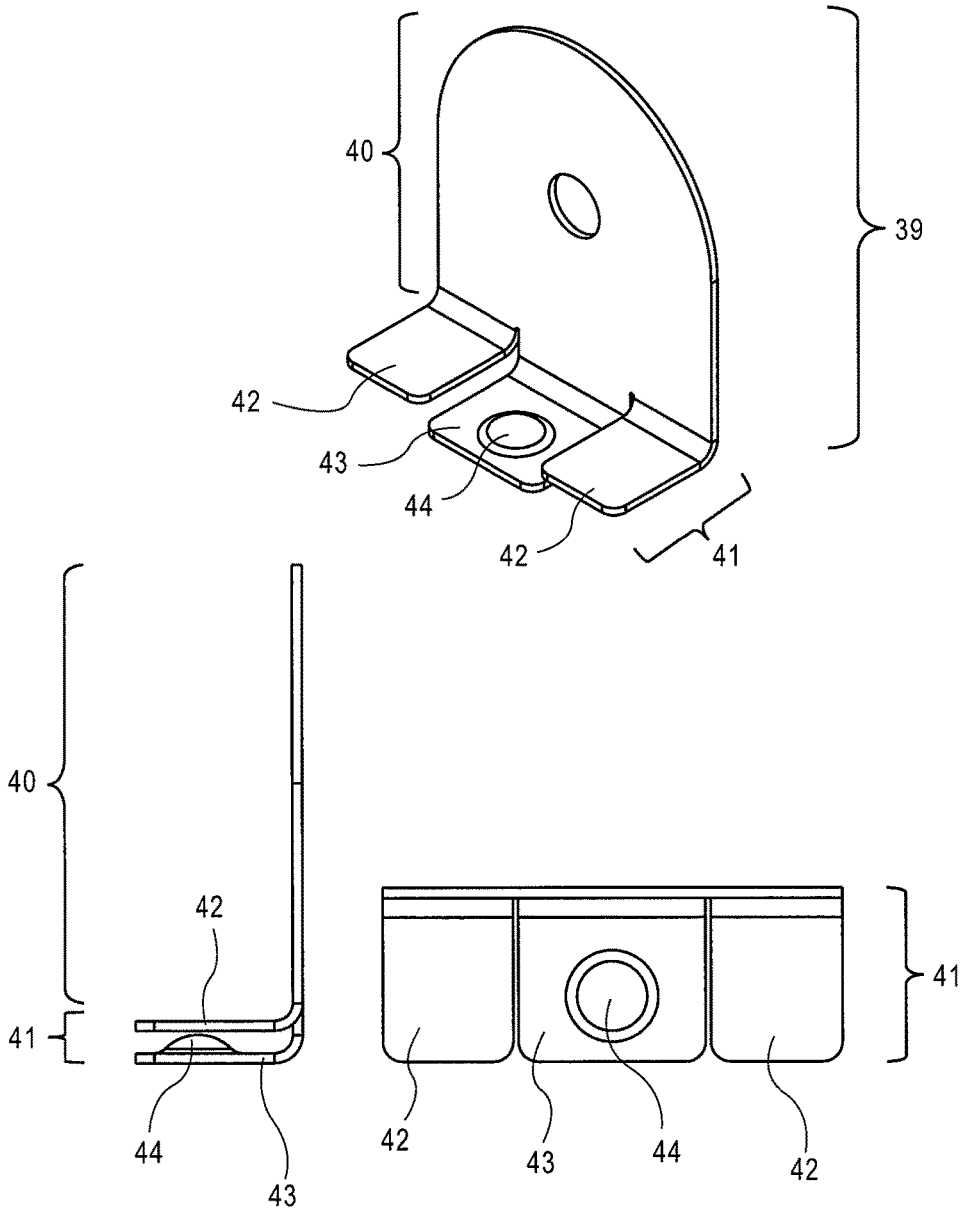
FIG. 12 shows a perspective view, side view, and bottom view of a torsion spring clip.
Figure 14:
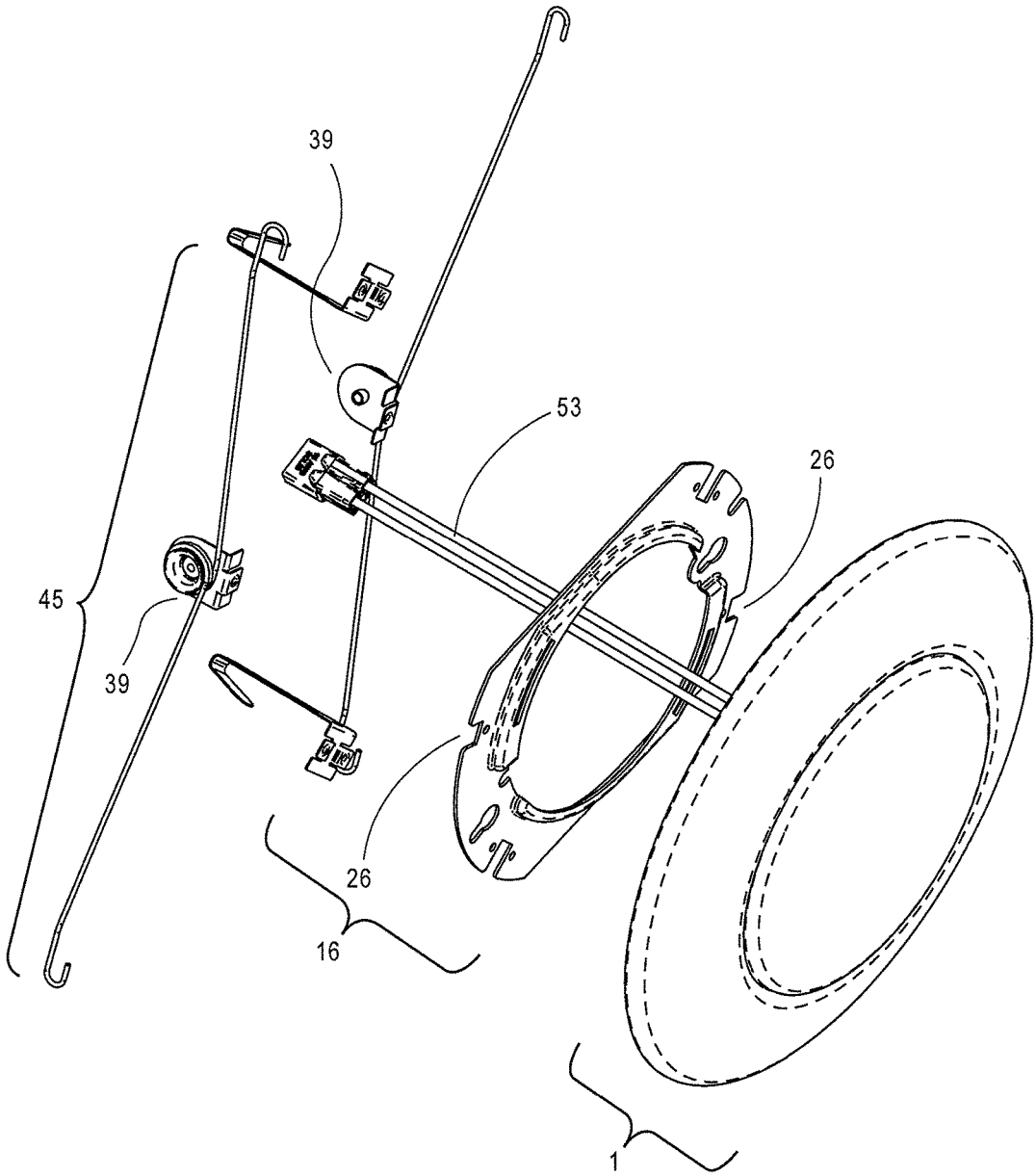
FIG. 14 shows an exploded view of a recessed lighting unit and its components, including the universal adapter, friction clips, and torsion spring clips, according to one embodiment.

In another embodiment, as shown in FIGS. 6, 13 and 14, a clip holder 26 may have one or more notches 29 formed on an outer edge of the universal adapter 17. Notches 29 may have a variety of shapes (e.g., circular, rectangular, square, or V-shape), and may be formed by cutting out a portion of the outer circumference or edge of the universal adapter 17. The clip holder 26 may have a bump opening 30 that is positioned adjacent to the notch 29 and radially inward relative to the notch 29. As shown in FIG. 12, a clip corresponding to the clip holder 26 may be a torsion spring clip 39 that is part of a torsion spring assembly 45. The torsion spring clip 39 may have a vertical clip portion 40, and a base clip portion 41 formed at the bottom of the vertical clip portion 40. The base clip portion 41 has a pair of lips 42 and a flange 43. The flange 43 may be formed on a lower plane in between the pair of lips 42. The flange 43 extends on a lower plane and in the same direction as the pair of lips 42. The flange 43 has a bump 44. As shown in FIG. 13, the base clip portion 41 is inserted into the clip holder 26 so that the bump 44 engages the bump opening 30 of the universal adapter 17 to secure the torsion spring clip 39 to the universal adapter 17. As described above, torsion spring assemblies 45 may be used to secure the housing 2 to an incandescent style housing 51 behind the ceiling or wall 55. In another embodiment, it is also possible that friction clip 32 may have a base clip portion 41, and torsion spring clip 39 may have a base clip portion 34.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A recessed lighting unit for mounting behind a ceiling or a wall comprising:

a thermally conductive housing having a trim portion, wherein the trim portion has an outer periphery and an inner periphery, wherein the housing extends rearward and inward from the inner periphery of the trim portion and forms an intermediate portion, wherein the housing extends rearward and inward from the intermediate portion and forms a base;

a light source module being attached to the base and positioned between a bottom of the base and a frontmost point of the trim portion;

an optical plate attached to the intermediate portion, the light source module to illuminate a back face of the optical plate, wherein an outer periphery of the optical plate conforms to an outer periphery of the intermediate portion so that a space between the optical plate and the base is enclosed; and a plurality of locking members, for engaging a universal adapter, that are directly formed on the intermediate portion and extend rearward from the intermediate portion of the housing.

2. The recessed lighting unit of claim 1, wherein the thermally conductive, die-formed housing is made from one of a group consisting of aluminum, brass, copper, polymer and steel.

3. The recessed lighting unit of claim 1, wherein the optical plate is attached to the intermediate portion by a snapping mechanism, glue, or heat stake.

4. The recessed lighting unit of claim 1, wherein the height from the bottom of the base up to the outer periphery of the trim portion is between ⅞ inch to 2 inches, wherein the height from the outer periphery of the trim portion to the top of the optical plate is ¾ inch to 1 inch, and wherein the width distance between the outer peripheries of the trim portion is approximately 6 inches to 8 inches.

5. The recessed lighting unit of claim 1, wherein the height from the bottom of the base up to the outer periphery of the trim portion is between ⅞ inch to 2 inches, wherein the height from the outer periphery of the trim portion to the top of the optical plate is ¾ inch to 1 inch, and wherein the width distance between the outer peripheries of the trim portion is approximately 4 inches to 6 inches.

6. The recessed lighting unit of claim 1, wherein the universal adapter has:

an opening that is capable of receiving a base of the thermally conductive housing;

a plurality of attaching member openings capable of receiving attaching members to allow the universal adapter to be attached to a junction box;

a plurality of arcuate openings that are positioned at the same radial distance from a center of the opening, each arcuate opening capable of receiving one of the plurality of locking members on the intermediate portion of the housing; and a plurality of clip holders capable of being attached to a plurality of clips;

wherein a portion of each of the plurality of locking members on the intermediate portion of the housing extend rearward through each of the plurality of arcuate openings on the universal adapter so that the housing and the universal adapter are in a locked position.

7. The recessed lighting unit of claim 6, wherein one of the plurality of clip holders comprises:

a notch formed on an outer edge of the universal adapter; and a pair of bump openings, wherein each bump opening is positioned adjacent to the notch.

8. The recessed lighting unit of claim 7, wherein the plurality of clip holders are attached to a plurality of friction clips, the friction clip comprising:

a vertical clip portion; and a base clip portion formed at the bottom of the vertical clip portion;

wherein the base clip portion has two parallel bars connected by a center bar, wherein the vertical clip portion is connected to the base clip portion along the length of one of the two parallel bars, wherein a pair of flanges extend outwardly on a lower plane from the center bar, and wherein each flange has a bump.

9. The recessed lighting unit of claim 6, wherein one of the plurality of clip holders comprises:

a notch formed on an outer edge of the universal adapter; and a single bump opening that is positioned adjacent to the notch and radially inward relative to the notch.

10. The recessed lighting unit of claim 9, wherein the plurality of clip holders are attached to a plurality of torsion spring clips, the torsion spring clip comprising:

a vertical clip portion;

a base clip portion formed at the bottom of the vertical clip portion;

wherein the base clip portion has a pair of lips and a flange, wherein a flange is formed on a lower plane in between the pair of lips, and wherein the flange has a bump.

11. The recessed lighting unit of claim 6, wherein the universal adapter further comprises:

a first set of two openings capable of receiving an attaching member, each located on opposite halves of the universal adapter, that allows the universal adapter to be attached to a first junction box; and a second set of two openings capable of receiving an attaching member, each located on opposite halves of the universal adapter, that allows the universal adapter to be attached to a second junction box;

wherein the distance between the first set of two openings is different than the distance between the second set of two openings.

12. The recessed lighting unit of claim 6, wherein the universal adapter further comprises:

a first opening capable of receiving an attaching member that allows the universal adapter to be attached to a first junction box or a second junction box;

a second opening capable of receiving an attaching member that allows the universal adapter to be attached to the first junction box; and a third opening capable of receiving an attaching member that allows the universal adapter to be attached to the second junction box;

wherein both the second opening and the third opening are located on opposite halves of the universal adapter relative to the first opening, and wherein the distance between the first opening and the second opening is different than the distance between the first opening and the third opening.

13. The recessed lighting unit of claim 1, wherein the thermally conductive housing is configured such that when the recessed lighting unit is mounted behind the ceiling, the light source module attached to the base of the thermally conductive housing is positioned above the ceiling, while the trim portion of the thermally conductive housing and the optical plate extend below the ceiling.

14. A recessed lighting unit for mounting behind a ceiling or a wall comprising:

a thermally conductive housing having a trim portion, wherein the trim portion has an outer periphery and an inner periphery, wherein the housing extends rearward and inward from the inner periphery of the trim portion and forms an intermediate portion, wherein the housing extends rearward and inward from the intermediate portion and forms a base;

a light source module being attached to the base and positioned between a bottom of the base and a frontmost point of the trim portion; and an optical plate attached to the intermediate portion, the light source module to illuminate a back face of the optical plate, wherein an outer periphery of the optical plate conforms to an outer periphery of the intermediate portion so that a space between the optical plate and the base is enclosed, wherein a plurality of locking members, for engaging a universal adapter, are attached to the intermediate portion so that a portion of each of the plurality of locking members extends rearward from the intermediate portion of the housing.

15. The recessed lighting unit of claim 14, wherein the universal adapter has:

an opening that is capable of receiving a base of the thermally conductive housing;

a plurality of attaching member openings capable of receiving attaching members to allow the universal adapter to be attached to a junction box;

a plurality of arcuate openings that are positioned at the same radial distance from a center of the opening, each arcuate opening capable of receiving one of the plurality of locking members on the intermediate portion of the housing; and a plurality of clip holders capable of being attached to a plurality of clips;

wherein a portion of each of the plurality of locking members on the intermediate portion of the housing extend rearward through each of the plurality of arcuate openings on the universal adapter so that the housing and the universal adapter are in a locked position.

16. The recessed lighting unit of claim 14, wherein the thermally conductive housing is configured such that when the recessed lighting unit is mounted behind the ceiling, the light source module attached to the base of the thermally conductive housing is positioned above the ceiling, while the trim portion of the thermally conductive housing and the optical plate extend below the ceiling.

17. A recessed lighting unit comprising:

a universal adapter having an opening that is capable of receiving a base of a thermally conductive housing;

one or more light emitting devices mounted to the thermally conductive housing;

wherein the universal adapter has a plurality of attaching member openings capable of receiving attaching members to allow the universal adapter to be attached to a junction box; and wherein the universal adapter has a plurality of arcuate openings that are positioned at the same radial distance from a center of the opening, each arcuate opening capable of receiving a corresponding locking member formed on the housing.

18. The recessed lighting unit of claim 17, wherein the thermally conductive housing is configured such that when the recessed lighting unit is mounted behind a ceiling, the one or more light emitting diodes mounted to the thermally conductive housing are positioned above the ceiling, while a trim portion of the thermally conductive housing and an optical plate of the recessed lighting unit extend below the ceiling.

* * * * *